US005691284A

United States Patent [19]

Beyer et al.

[11] Patent Number: 5,691,284

[45] Date of Patent: Nov. 25, 1997

[54] SYNTHETIC OLIGOMERIC OILS

[75] Inventors: Claudia Beyer, Seeheim-Jugenheim; Ruediger Jelitte, Rossdorf; Horst Pennewiss, Darmstadt; Heinz Jost, Modautal-Brandau, all of Germany

[73] Assignee: Röhm GmbH, Darmstadt, Germany

[21] Appl. No.: 773,032

[22] Filed: Dec. 24, 1996

Related U.S. Application Data

[63] Continuation-in-part of Ser. No. 587,041, Jan. 16, 1996, abandoned, which is a continuation of Ser. No. 455,634, May 31, 1995, abandoned, which is a continuation of Ser. No. 271,242, Jul. 6, 1994, abandoned, which is a continuation of Ser. No. 123,186, Sep. 16, 1993, abandoned, which is a continuation of Ser. No. 987,066, Dec. 7, 1992, abandoned, which is a continuation of Ser. No. 741,132, Aug. 7, 1991, abandoned.

[30] Foreign Application Priority Data

Aug. 11, 1990 [DE] Germany ..... 40 25 494.1

[51] Int. Cl.[6] ..... C10M 145/14

[52] U.S. Cl. ..... 508/472

[58] Field of Search ..... 508/472

[56] References Cited

U.S. PATENT DOCUMENTS

| | | | |
|---|---|---|---|
| 3,968,148 | 7/1976 | Leister et al. | 508/472 |
| 3,994,958 | 11/1976 | Leister et al. . | |
| 4,009,195 | 2/1977 | Leister et al. . | |
| 4,419,106 | 12/1983 | Miller . | |
| 4,526,950 | 7/1985 | Grava . | |
| 4,533,482 | 8/1985 | Bollinger | 508/472 |
| 5,026,496 | 6/1991 | Takigawa et al. | 508/472 |
| 5,306,437 | 4/1994 | Heinrichs et al. | 508/472 |

*Primary Examiner*—Ellen M. McAvoy

[57] ABSTRACT

Synthetic oils comprising 5–100 percent by weight of an oligomer of

A) 0–75 wt. % of at least one 1-alkene,

B) 20–100 wt. % of at least one (meth)acrylic acid ester of the formula wherein R is hydrogen or methyl and $R_1$ is optionally branched alkyl or cycloalkyl, and C) 0–65 wt. % of a (meth)acrylic acid ester of the formula wherein R' is hydrogen or methyl and $R_2$ is alkyl substituted with at least one hydroxy group or is wherein $R_3$ and $R_4$ are hydrogen or methyl, $R_5$ is hydrogen or optionally branched alkyl, but if n is 1, then $R_5$ is exclusively optionally branched alkyl.

6 Claims, No Drawings

SYNTHETIC OLIGOMERIC OILS

This application is a continuation-in-part of application Ser. No. 08/587,041 filed Jan. 16, 1996 and now abandoned; which in turn is a continuation of application Ser. No. 08/455,634 filed May 31, 1995 and now abandoned; which is turn is a continuation of application Ser. No. 08/271,242 filed Jul. 6, 1994 and now abandoned; which in turn is a continuation of application Ser. No. 08/123,186 filed Sep. 16, 1993 and now abandoned; which in turn is a continuation of application Ser. No. 07/987,066 filed Dec. 7, 1992 and now abandoned; which in turn is a continuation of application Ser. No. 07/741,132 filed Aug. 7, 1991 and now abandoned.

FIELD OF THE INVENTION

The present invention relates to synthetic oils which entirely or partially consist of oligomers, including homo- and cooligomers, of (meth)acrylic acid esters alone or with α-olefins.

STATE OF THE ART

The often extreme demands which modern machinery place on lubrication have led to the development of synthetic lubricants (synthetic oils). (Cf. *Ullmann's Encyclopädie der technischen Chemie,* 4th ed., vol. 20, pp 503–530, Verlag Chemic 1981).

The common synthetic oils belong to different material classes such as polyolefins and alkylaromatics, in addition to polyethers, esters (of monobasic and polybasic carboxylic acids with monohydroxy and polyhydroxy alcohols), phosphoric acid esters and phosphonic acid esters, silicones, silicate esters, polyhalohydrocarbons, and fluorinated esters.

Polymers which are obtained from α-olefins of various provenances and by differing polymerization methods are of particular interest. Thus, polymers of α-olefins having 8–12 C-atoms, which are obtained, for example, using Ziegler catalysts or catalysts for ionic polymerization, are significant because of their good VI and pour point values.

A relatively good compatibility with rubber materials is attributed to mixtures of such α-olefin oligomers with ester oils. A further advantage described for them is the improved miscibility of the olefin oligomer/ester mixtures, in comparison with the pure components, with polar additives. Further, cooligomers or copolymers of α-olefins with (meth) acrylic acid esters have become of technical interest. In comparison with the longer, common, pure polymethacrylate polymers, the thermal stability of the additives is strongly improved by the included α-olefin.

U.S. Pat. No. 4,419,106 describes oil preparations which have a hydrocarbon oil and a fraction of a pour point depressant consisting of a copolymer of about 10–90 percent by weight of alkyl acrylate units containing 8–20 alkyl-C-atoms and 90–10 percent by weight of α-monoolefin units having 12–40 C-atoms per 100 percent by weight of copolymer having a molecular weight, $M_w$, of 1000–100,000.

For example, oligomers of this type composed of three different monomer groups are described in U.S. Pat. No. 3,968,148 or German DE-A 22 43 064, as well as their use as VI improvers. What is claimed are oligomers of:

| | |
|---|---|
| ca. 10–90 wt. % | of a 1-alkene having 4 to 32 C-atoms |
| ca. 1–35 wt. % | of one or more alkyl (meth)acrylic acid esters having 8–34 C-atoms in the alkyl portion and |
| ca. 1–35 wt. % | of one or more alkyl esters of (meth)acrylic acid or of homologous, terminally unsaturated carboxylic acids having 1–4 C-atoms in the alkyl portion. |

The molecular weight of this kind of oligomer is preferably $M_n$=1000 to 4000. The narrow molecular weight range achieved and the high uniformity of the products are emphasized.

U.S. Pat. No. 4,009,195 further describes an oligomerization method in which the most different (meth)acrylic acid derivatives, such as C1–C4-alkyl esters in amounts from 1–35 percent by weight with (meth) acrylic acid esters of C8–C34-alkanols in amounts from 1–45 percent by weight are added continuously and simultaneously to a mixture of free radical initiators and 10–90 percent by weight of a 1-alkene having 4–32 C-atoms in such a way that the molar ratio, which essentially is immediately established, of acid derivative to 1-alkene in the reaction batch is held relatively constant in the range from 0.001 to 0.2, the addition taking place at a temperature which does not impair the oligomerization.

Derived from the same parent application as the aforementioned U.S. patent is U.S. Pat. No. 3,994,958, according to which an oligomer whose composition is encompassed by the aforementioned U.S. patent is subsequently reacted with an alkylene diamine in order to obtain VI improvers having dispersant activity.

Further, DE-A 32 23 694 claims copolymers of α,β-unsaturated dicarboxylic acid esters with α-olefins. The α,β-unsaturated dicarboxylic acid esters in this case contain, by definition, linear or branched monoalcohols having 3–10 carbon atoms as the alcohol component; the α-olefins have 10–16 carbon atoms. The copolymers can optionally be crosslinked and their pour point is said to lie between −60° C. and 0° C.

Copolymers having a content of isocyanate groups in the molecular weight range 500–10,000 can be prepared by solution polymerization of C1–C20-alkyl esters of (meth) acrylic acid and olefins with 1-alkenyl isocyanates (compare DE-A 32 45 298).

A method of making copolymers is described in U.S. Pat. No. 4,526,950, in which, starting with at least one α-olefin having at least 6 C-atoms and at least one unsaturated carboxylic acid or its derivatives which are copolymerizable with the olefins, the mixture of components is heated to at least 135° C. in the presence of a free radical initiator and in the absence of solvents or diluting agents, whereby none of the reactive monomers is used in excess in order to avoid any dilution effect. Further, SU-A 1,135,752 claims copolymers of decyl methacrylate and tetradecene having a molecular weight of 8000–13000 as a thickener for lubricating oils.

Oil additives comprising ethylene copolymers, inter alia with ethylenically unsaturated monocarboxylic or dicarboxylic acids or their esters, having a molecular weight $M_n$ of <1000 are known from EP-A 217,602.

Problem and Solution

The state of the art described above makes it clear that the class of methacrylate/α-olefin copolymers and their use as additives for petroleum oils has been given relatively much attention. However, this class of compounds as yet stands in no direct technological connection with the so-called "synthetic oils".

Synthetic oils of the state of the art are usually made up of hydrocarbons, such as oligomers of 1-decene, and/or esters, for example dicarboxylic esters. (*Ullmann's Encyclopädie der technischen Chemie, op.cit.*, pp. 503–530).

However both of the classes of substances used have disadvantages. The polyolefins, because of their nonpolar structure, have too little solubility if they are to be used together with polar additives, for example extreme pressure additives (EPA).

Because of their polar structure, the esters show known considerable disadvantages, such as miscibility problems with petroleum oils and oils having a non-petroleum base, as well as bad compatibility with sealing materials. Further, the ester function can give rise to hydrolysis, with the result that the corrosion of metal parts is promoted.

It has been sought to compensate for the named disadvantages by mixing hydrocarbons with esters, but in practice this requires considerable development effort.

If the synthetic oil mixtures are to have a dispersing action, for example, for black sludge, it is necessary additionally to add low or high molecular weight substances (e.g. "ashless dispersants" of the polyisobutenyl succinimide type or VI improvers provided with polar groups). This means a considerable expenditure. Further, these compounds, which mostly contain nitrogen, can cause sealing problems. To the extent the cooligomers of the invention contain component C), a dispersing effect is obtained without the notorious problems, particularly incompatibility with sealants, which occur with the use of, for example, monomers containing nitrogen.

It has now been found that the (meth) acrylic acid ester/α-olefin cooligomers of the present invention fulfill the demands of technology to a particular degree.

The present invention relates to wholly or partly synthetic oils containing, in addition to the usual components, 5–100 percent by weight of cooligomers composed of:

A) 0–75, preferably 10–70, and very specially 10–40, percent by weight of at least one 1-alkene having 4 to 32 carbon atoms, suitably 8–14 carbon atoms, and preferably 10–14 carbon atoms, in the molecule, B) 20–100, preferably 40–90, percent by weight of at least one (meth)acrylic acid ester of the formula

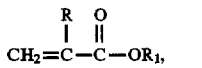

wherein R stands for hydrogen or methyl and $R_1$ stands for a linear and/or branched alkyl group or a cycloalkyl group having 4 to 32 carbon atoms, preferably 8 to 20 carbons atoms, C) 0–65, preferably 5–40, percent by weight of a (meth) acrylic acid ester of the formula

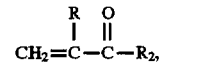

wherein R' stands for hydrogen or methyl and $R_2$ stands for an alkyl group having 2 to 6 carbon atoms substituted with at least one hydroxy group, or for a group

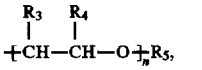

wherein $R_3$ and $R_4$ stand for hydrogen or methyl, $R_5$ stands for hydrogen or an optionally branched alkyl group having 1 to 40, preferably 1 to 20, carbon atoms, and n is a whole number from 1 to 60, with the proviso that if n is 1, then $R_5$ is exclusively an optionally branched alkyl group having 1 to 40 carbon atoms.

Components A), B), and C) in the cooligomers should add up to 100%.

The cooligomers according to the invention lie in the molecular weight region from 1000 to 100,000, preferably from 1500 to 25,000. (Determination by gel permeation chromatography, see H. F. Mark et al., *Encyclopedia of Polymer Science & Technology*, vol. 10, pp. 1–19, J. Wiley 1987).

Exemplary of representatives of component A) are the following:

butene-1, pentene-1, hexene-1, heptene-1, octene-1, nonene-1, decene-1, undecene-1, dodecene-1, tridecene-1, tetradecene1, pentadecene-1, hexadecene-1, heptadecene-1, octadecene-1, nonadecene-1, eicosene-1, heneicosene-1, docosene-1, trocosene-1. tetracosene-1, pentacosene-1, hexacosene-1, heptacosene-1, octacosene-1, nonacosene-1, triacontene-1, hentriacontene-1, dotriacontene-1, or the like. Branched alkenes, for example vinylcyclohexane, 3,3-dimethylbutene-1, 3-methylbutene-1, diisobutylene-4-methylpentene-1 or the like are also suitable.

Also, alkene-1 compounds having 10 to 32 carbon atoms such as are obtained by the polymerization of ethylene, propylene, or mixtures thereof, are suitable, the starting materials in turn being obtained from hydrocracked materials.

That variant in which component A) of the cooligomer stands for decene-1 or for dodecene or tetradecene is particularly preferred. Very particularly preferred is decene, the use of which gives the best low temperature behavior (pour point).

Further, those cooligomers are of particular interest wherein component B) consists of (meth) acrylic acid esters having 4–24, preferably 8–22, carbon atoms in the alkyl portion or of mixtures of these materials.

For example, the following monomers are named: butyl acrylate, 2-ethylhexyl acrylate, cyclohexyl acrylate, isodecyl acrylate, decyl acrylate, undecyl acrylate, dodecyl acrylate, tridecyl acrylate, tetradecyl acrylate, pentadecyl acrylate, dodecylpentadecyl acrylate, hexadecyl acrylate, heptadecyl acrylate, octadecyl acrylate, cetylstearyl acrylate, oleyl acrylate, nonadecyl acrylate, eicosyl acrylate, cetyleicosyl acrylate, stearyleicosyl acrylate, docosyl acrylate, eicosyltetratriacontyl acrylate, or the corresponding methacrylates.

Alkyl methacrylates have 10 or more carbon atoms in the alkyl portion and having a high iso-fraction are preferred. For example, C12–C15-alkyl esters of methacrylic acid having ca. 60–90 % iso-fraction, as well as isodecyl methacrylate, are mentioned. A high degree of branching is favorable with regard to low temperature properties, including pour points, and a certain C-number distribution improves the viscosity-temperature behavior (as is expressed, e.g., in the VI values). In other words, one needs high branching plus a certain C-number distribution (e.g. $C_{12}$–$C_{15}$, 80% branched) in order to have all these advantages in one and the same product.

Cooligomers of the kind described are completely comparable with state of the art components of synthetic oils with respect to characteristic values such as viscosities, VI-index, low temperature behavior, stability to evaporation and oxidation, and further properties relevant to practical use. However, in contrast to the described state of the art, they have the following advantages:

Because of the combination of polar with nonpolar monomers, there are no miscibility problems with petroleum oils, poly-α-olefins (PAO), esters, or other base liquids, as well as no solvent capacity problems with additives. The behavior toward sealant materials is absolutely neutral, and corrosion because of acid formation can also be excluded.

Further, it has been found that, surprisingly, synthetic oil mixtures of the cooligomers, for example with polyolefins and/or esters, show a VI-index clearly increased in comparison with the individual components, which is attributable to the influence of the oligomer. Also, the cooligomer component acts such that clearly lower low temperature viscosities are possible, as for example in mixtures with synthetic hydrocarbons or diester oils. (Measured in a Cold Cranking Simulator, see Example 12.) Behavior under heavy thermal-oxidative loading is outstanding, despite the presence of residual double bonds. (Example 18, VW-TD-motor test, comparison with PAO formulation.)

If oligomers which also contain component C) in sufficient amount are used as components of synthetic oil, a good dispersing effect is given, but for which sealant problems caused by nitrogenous dispersing groups are avoided and there are no forfeitures in the shear stability of the mixture, as for example occur in the use of high molecular weight VI improvers.

All this has as a consequence that the characteristic properties for various petroleum oil specifications can be attained without any high molecular weight VI improvers or with much smaller amounts thereof that usual. Because of this, there are inter alia advantages with respect to shear stability. Further, the danger of the formation of sediments is lessened.

The Synthetic Oils

By "synthetic oils" are particularly to be understood the poly-α-olefins (PAO) preferred by technical science, as well as organic esters such as dicarboxylic acid- and polyol esters [cf. E. I. Williamson, J. Synth. Lubr. 2(4) 329–341 (1986) and 3(1) 45–53 (1987); A. Plagge, Tribologie und Schmierungstechnik 34, 148–156 (1987); Ullmann, op. cit., pp. 514–821].

Crack olefins, predominantly having a boiling point between 30° and 300° C. are used as starting materials for the poly-α-olefins. The poly-α-olefins as a rule correspond to the general formula

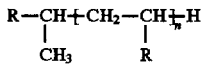

wherein R stands for an alkyl group, particularly having 6–10 carbon atoms, with a molecular weight commonly of 300–6000 ($M_w$).

As organic esters, on the one hand are mentioned the esters of dicarboxylic acids having 3 to 17 C-atoms, such as adipic acid, azelaic acid, and sebacic acid with primary alcohols—in this case the most important alcohol components are polyalkylene glycols—and, on the other hand, the monocarboxylic acid esters, particularly the esters of C6–C12-carboxylic acids with particular branched alcohols, especially those having a neopentyl skeleton, such as neopentyl alcohol, trimethylolpropane, and pentaerythritol. The ester oils show a high capacity for adsorption on metal surfaces and, therewith, good lubricating properties, to be sure at the price of relative sensitivity toward (hydrolytic) decomposition, so that corrosive decomposition products can appear.

The viscosities extend, for example, from values around 5.9 ($mm^2/s$ at 38° C.) for the neopentylglycol ester of n-C6-acid up to a value of 36.4 for the corresponding ester of n-C12-acid.

Preparation of the Cooligomers

As is known from the state of the art, cooligomers of the type claimed herein can be prepared by free radical-induced polymerization under specific conditions, for example by thermal polymerization and with addition of a suitable initiator or redox system. The polymerization can be carried out in the absence of a solvent, but also in the presence of suitable solvents. According to this method, all ordinary solvents indicated as polymerization media can be used, as well as petroleum oils, hydrocracked oils, PAO, esters, or already-prepared oligomer. In this way, the 1-alkene according to component A) can be put into a suitable reaction vessel and brought to a suitable reaction temperature. In general, a temperature range from 80° C. to 200° C. particularly 160° C.±20° C., serves as a useful region. Component B), or B)+C), is added thereto in the same temperature range, advantageously as a feed over a certain period of time, for example 0.25–10 hours, for example within 5½ hours, in the amounts provided therefor. Suitably, the batch is completely polymerized for some further time, as a rule several hours—about 6 hours can be given as a guide. It has proved advantageous to add the initiator during the entire reaction, e.g. portionwise at about thirty-minute intervals or also continuously in the manner of a feed. Free radical starters, known per se, are used as initiators (cf. Kirk-Othmer, *Encyclopedia of Chemical Technology*, 3rd. ed., vol. 13, pp. 355–373, Wiley Interscience 1981; Rauch-Puntigam, *Acryl- und Methacrylverbindungen*, pP. 106 et seq., Springer Verlag, Berlin, New York 1967). The total amounts of initiator used lie as a rule in the range from 0.1–10, preferably in the range from 0.1–5, percent by total weight of the monomers. Suitably, initiators are chosen the decomposition characteristics of which are suited to the modalities of the polymerization. As a guide value, a half-life of the initiator of about 0.25 hour (in benzene) at the reaction temperature can be mentioned. To these materials belong, for example, peroxidic initiators, such as di-tert.-butyl peroxide. As a guide, the addition of from 0.001–0.005 mol of initiator, per portion of a portionwise addition, can be given.

According to results at hand, the conversion of the monomers is,.for example, about 98%, so that in many cases a separation of the monomers, indeed even any further working up, is obviated. If the end use demands a high flash point, for example, residual monomer must be removed.

The products are generally colorless oily liquids which mix completely with petroleum oils, PAO, hydrocracked oils, and ester oils.

The following Examples are given by way of illustration.

In them, the physical data were determined according to the following standards: (Cf. Ullmann, 4th ed., vol. 20, loc.cit.; F. H. Mark et al, vol. 10, loc.cit.)

Viscosity:

η(100° C. and 40° C.) (according to DIN 51 562 or ASTM D445 in an Ubbelohde capillary viscosimeter)

VI calculated from the 40° C. and 100° C. viscosity of the base oil

Pour point: in a pour point apparatus according to DIN 51 583

Molecular weight: by gel chromatography against polymethyl methacrylate as a standard Inhomogeneity: $U=M_w/M_n-1$ Noacknumber: according to DIN 51 581.

The abbreviation "AMA" stands for alkyl methacrylate, "PAO" stands for poly-a-olefin, "TMA-OD-Ester" stands for the ester of trimethylolpropane with adipic acid.

EXAMPLES

Examples of the Method

Example 1

1 mol of decene-1 (140 g) is heated to 160° C. in a reaction vessel. A mixture of 0.5 mol of isodecyl methacrylate (113 g) and 0.5 mol of C12–C15-alkyl methacrylate having a 60% iso-fraction (136 g) is now fed in over 4 hours. At the end of the feed, the batch is polymerized for another 12 hours. During the entire reaction time of 16 hours, with the exception of the last hour, di-tert.-butyl peroxide is added at 30-minute intervals (here, 30 portions, total amount 2.8 wt. % based on the monomers).

At the end of the reaction, the conversion of the monomers was about 98%.

The product is a colorless oily liquid which is completely miscible with petroleum oils, polyolefins, or ester oils.

| Material data: | |
|---|---|
| η (100° C.) = | 45.1 $mm^2/s$ |
| η (40° C.) = | 489.0 $mm^2/s$ |
| VI = | 146 |
| Pour point = | −43.2° C. |
| $M_w$ = | 4000 |
| $M_n$ = | 1790 |
| U = | 1.23 |
| Evaporation loss (Noack) = | 4–5 wt. % |

Example 2

Performed as in Example 1, except feed of the methacrylate mixture over 1.5 hours.

| Material data: | |
|---|---|
| η (100° C.) = | 94.9 $mm^2/s$ |
| η (40° C.) = | 1210.8 $mm^2/s$ |
| VI = | 164 |
| Pour point = | −33.6° C. |
| $M_w$ = | 8330 |
| $M_n$ = | 2280 |
| U = | 2.65 |
| Monomer conversion = | 95% |

Example 3

As in Example 1, but the reaction temperature is 140° C. and the initiator is tert.-butyl perbenzoate.

| Material data: | |
|---|---|
| η (100° C.) = | 87.8 $mm^2/s$ |
| η (40° C.) = | 1888.3 $mm^2/s$ |
| VI = | 154 |
| Pour point = | −34.7° C. |
| $M_w$ = | 6890 |
| $M_n$ = | 2240 |
| U = | 2.00 |
| Monomer conversion = | 97% |

Example 4

2 mols of decene-1 (280 g) are heated to 160° C. in a reaction vessel. 1 mol of isodecyl methacrylate (227 g) is fed in at this temperature over 5 hours. At the end of the feed, the batch was further polymerized for another 6 hours. During the entire reaction time of 11 hours, with the exception of the last hour, di-tert.-butyl peroxide as an initiator is added at 30-minute intervals (here, 20 portions totalling 4.3 wt. % based on the monomers).

At the end of the reaction the conversion of the monomers was ca. 92%.

| Material data: | |
|---|---|
| η (100° C.) = | 25.9 $mm^2/s$ |
| η (40° C.) = | 250.3 $mm^2/s$ |
| VI = | 134 |
| Pour point = | −48.4° C. |
| $M_w$ = | 2240 |
| $M_n$ = | 1370 |
| U = | 0.64 |

Example 5

As in Example 4, but isodecyl methacrylate/decene 1:1 mol. Total amount of initiator 2.8 wt. %

| Material data: | |
|---|---|
| η (100° C.) = | 47.6 $mm^2/s$ |
| η (40° C.) = | 603.8 $mm^2/s$ |
| VI = | 132 |
| Pour point = | −38.9° C. |
| $M_w$ = | 3120 |
| $M_n$ = | 1610 |
| U = | 0.94 |

Example 6

As in Example 4, but isodecyl methacrylate: decene in a mol ratio of 1:0.25. Total amount of initiator=2.8 wt. %.

| Material Data: | |
|---|---|
| η (100° C.) = | 424.6 $mm^2/s$ |
| η (40° C.) = | 1219.7 $mm^2/s$ |
| VI = | 170 |
| Pour point = | −10.7° C. |
| $M_w$ = | 12300 |
| $M_n$ = | 2890 |
| U = | 3.26 |
| Monomer conversion = | 98% |

Example 7

As in Example 6, but feed of the isodecyl methacrylate over 2.5 hours. Total amount of initiator=2.8 wt. %.

| Material Data: | |
|---|---|
| η (100° C.) = | 888.2 $mm^2/s$ |
| η (40° C.) = | 27162 $mm^2/s$ |
| VI = | 206 |
| Pour point = | (too viscous) |
| $M_w$ = | 24800 |
| $M_n$ = | 3480 |
| U = | 6.12 |
| Monomer conversion > | 99% |

Example 8

As in Example 5, but reaction temperature is 140° C. Initiator: tert.-butyl perbenzoate, 4.8 wt. %.

| Material Data: | |
|---|---|
| η (100° C.) = | 130.7 $mm^2/s$ |
| η (40° C.) = | 2335.1 $mm^2/s$ |
| VI = | 147 |
| Pour point = | −25.9° C. |
| $M_w$ = | 6690 |
| $M_n$ = | 2200 |
| U = | 2.04 |
| Monomer conversion = | 96% |

Example 9

As in Example 5, but reaction temperature is 126° C. Initiator: tert.-butyl pernonoate, 4.8 wt. %

| Material Data: | |
|---|---|
| η (100° C.) = | 460.1 $mm^2/s$ |
| η (40° C.) = | 12321.7 $mm^2/s$ |
| VI = | 180 |
| Pour point = | −8.5° C. |
| $M_w$ = | 11800 |
| $M_n$ = | 2560 |
| U = | 2.31 |
| Monomer conversion = | 88% |

Example 10

Performed as in Example 4, but 280 g of the synthetic oil prepared according to Example 4 is used as a solvent in addition to 1 mol of decene-1.

| Material Data: | |
|---|---|
| η (100° C.) = | 28.0 $mm^2/s$ |
| η (40° C.) = | 294.0 $mm^2/s$ |
| VI = | 127 |
| Pour point = | −44.5°C. |
| $M_w$ = | 2180 |
| $M_n$ = | 1350 |
| U = | 0.61 |
| Monomer conversion = | 98% |

Example 11

As in Example 1, but the methacrylate component is butyl methacrylate. Feed time is 3.5 hours.

| Material Data: | |
|---|---|
| η (100° C.) = | 1480 $mm^2/s$ |
| η (40° C.) = | 2836.2 $mm^2/s$ |
| VI = | 147 |
| Pour point = | −26° C. |
| $M_w$ = | 6500 |
| $M_n$ = | 1860 |
| U = | 2.51 |
| Monomer conversion = | 91% |

Example 12

3 mols of dodecane (532 g) are heated to 160° C. in a reaction vessel. 1 mol of C12–C15-alkyl methacrylate having a 90% iso-fraction (272 g) is fed in over 5.5 hours. At the end of the feed, the batch is further polymerized for 11 hours. Addition of initiator is as described in Example 1. After the reaction, the solvent is removed by distillation. The product obtained is a colorless oily liquid which is completely miscible with petroleum oils, PAO, or ester oils.

| Material data: | |
|---|---|
| η (100° C.) = | 16.7 $mm^2/s$ |
| η (40° C.) = | 128.1 $mm^2/s$ |
| VI = | 141 |
| Pour point < | −52.1° C. |
| $M_w$ = | 1510 |
| $M_n$ = | 1230 |
| U = | 0.23 |
| Evaporation loss (Noack) = | 6% |
| Monomer conversion = | 95% |

Example 13

As in Example 12, but using the same amount by weight of hydrocracked oil instead of dodecane as solvent.

| Material data for hydrocracked oil: | |
|---|---|
| η (100° C.) = | 3.62 $mm^2/s$ |
| VI = | 126 |
| Pour point = | −33.0° C. |
| Material data for the oligomer/oil mixture obtained: | |
| η (100° C.) = | 5.08 $mm^2/s$ |
| η (40° C.) = | 24.1 $mm^2/s$ |
| VI = | 144 |
| Pour point = | −34.5° C. |

Example 14

400 g (0.28 mol) of C1* are dissolved in 450 g (1.99 mols) of isodecyl methacrylate. 250 g (1.78 mols) of decene-1 are heated to 140° C. in a reaction vessel. Over 1.5 hours, the methacrylate mixture is fed in. At the end of the feed, the batch is further polymerized for 15 hours. Initiator addition is as described in Example 1. The initiator is tert.-butyl perbenzoate, total amount about 3 percent by weight. The product obtained is a yellowish oil which is soluble in petroleum oil.

*C1 is the methacrylic acid ester of an ethoxylated C16–C18-fatty alcohol mixture, average degree of ethoxylation 25. Here, the alcohol "Marlipal 1618/25" a product of Hüls AG, is used.

| Material data: | |
|---|---|
| η (100° C.) = | 1006 $mm^2/s$ |
| η (40° C.) = | 15756 $mm^2/s$ |
| VI = | 276 |
| Pour point = | (too viscous) |
| $M_w$, $M_n$ = | (not determinable by gel permeation chromatography because of strong adsorption) |
| Monomer conversion = | 98% |

Example 15

300 g (0.37 mol) of component C2** is dissolved in 400 g (1.77 mols) of isodecyl methacrylate. 300 g (2.14 mols) of decene-1 are heating to 160° C. in a reaction vessel. The methacrylate mixture is fed in over 2 hours. The total reaction time is 16.5 hours. Initiator addition as in Example 1. Initiator: di-tert.-butyl peroxide, total amount about 3 wt. %. The product is soluble in petroleum oil.

**C2 is the methacrylic acid ester of methoxypolyethylene glycol, average degree of ethoxylation 16. Here, the alcohol "Carbowax 75" of Union Carbide is used.

| Material data: | |
|---|---|
| η (100° C.) = | 293.4 $mm^2/s$ |
| η (40° C.) = | 3999.0 $mm^2/s$ |
| VI = | 217 |
| Pour point = | −22.1° C. |
| $M_w$, $M_n$ | (not determinable by gel permeation chromatography because of strong adsorption) |
| Monomer conversion | nearly 100% |

Example 16

As in Example 5, but using C12–C15-alkyl methacrylate having a 90% iso-fraction instead of isodecyl methacrylate.

| Material Data: | |
|---|---|
| η (100° C.) = | 41.8 $mm^2/s$ |
| η (40° C.) = | 417.6 $mm^2/s$ |
| VI = | 152 |
| Pour point = | −44.1° C. |
| $M_w$ = | 3430 |
| $M_n$ = | 1830 |
| U = | 0.78 |

Example 17

As in Example 1, but the methacrylate component is C12–C15-alkyl methacrylate (90% iso). AMA: decene mol ratio=1:0.5. Feed of AMA over 1 hour.

| Material Data: | |
|---|---|
| η (100° C.) = | 234.4 $mm^2/s$ |
| η (40° C.) = | 4810.6 $mm^2/s$ |
| VI = | 165 |
| Pour point = | −25.6° C. |
| $M_w$ = | 23100 |
| $M_n$ = | 3230 |
| U = | 6.14 |

Examples of Applied Technology

Example 18

Comparison of viscosity data for an oligomer/ester oil mixture with a poly-α-olefin/ester oil mixture.

| | 20% PAO 100 in TMA-OD ester | 20% oligomer from Example 17 in TMA-OD ester |
|---|---|---|
| η (100° C.) | 6.68 $mm^2/s$ | 7.70 $mm^2/s$ |
| VI | 193 | 212 |
| CCS (−30° C.)* | 1800 mPa s | 1600 mPa s |

It is clearly recognizable that with the cooligomer in the mixture a lower viscosity at −30° C., and thus a better low temperature behavior, is attainable, despite a higher viscosity at 100° C.

*CCS = Cold Cranking Simulator, a method for determining viscosities at low temperatures at relatively high shear rates.

The method is described in ASTM D 2606.

Example 19

Comparison of an oligomer/PAO formulation with a PAO6/PAO40 formulation in the VW-TD motor test*.

| | PAO40 in PAO6 | Oligomer from Example 18 in PAO6 |
|---|---|---|
| Formulation | 45% PA040<br>14.2% commercial DI package<br>40.8% PAO6 | 45% oligomer<br>14.2% commercial DI package<br>40.8% PAO6 |
| η (100° C.) | 19.5 $mm^2/s$ | 18.7 $mm^2/s$ |
| VI | 147 | 148 |
| SAE-class | 10W-50 | 10W-50 |
| VW-TD result | 63.7 points, all rings free | 67.2 points, all rings free |

With the oligomer/PAO mixture, an outstanding Diesel evaluation can be achieved, which indicates very good thermal-oxidative stability. It is further to be noted that the pure poly-α-olefin formulation used for comparison exhibits very good Diesel performance, as is known.

*VW-TD=Volkswagen Turbo Diesel Engine Test. The specification for this test is defined in CEC L35-T84.

Example 20

1 mmol of 1-decene (140 g) is heated to 160° C. in a reaction vessel. 0.67 mol of iosodecyl acrylate (140 g) are fed in over 2 hours. At the end of the feed, the batch is further polymerized for 14 hours. During the entire reaction period of 16 hours with the exception of the last hour, di-tert-butyl peroxide is added continuously (total amount 8.4 g, which is 3 wt-. % based on the monomers).

The reaction product is an oily liquid which is miscible with mineral oil, polyolefins, or ester oils.

| Material data: | |
|---|---|
| η (100° C.) = | 61.6 $mm^2/s$ |
| η (40° C.0 = | 663.7 $mm^2/s$ |
| VI = | 161 |
| Pour point = | −45.8° C. |
| $M_w$ = | 5120 |
| $M_n$ = | 2520 |
| U = | 1.03 |

Monomer conversion about 93%

What is claimed is:

1. A co-oligomer adaptable to use as a synthetic oil, or a mixture of such a co-oligomer with up to 95 percent by weight of a conventional synthetic oil, said co-oligomer consisting of A) 10–70 percent by weight of at least one 1-alkene have 8 to 14 carbon atoms in the molecule, B) the balance being at least one (meth)acrylic acid ester of the formula $$CH_2{=}\overset{\overset{\displaystyle R}{|}}{C}{-}\overset{\overset{\displaystyle O}{||}}{C}{-}OR_1,$$

where R is hydrogen or methyl and $R_1$ is alkyl or cycloalkyl having 8 to 20 carbon atoms.

2. A co-oligomer or mixture as in claim 1 wherein said co-oligomer has a molecular weight from 1500 to 25,000.

3. A co-oligomer or mixture as in claim 1 wherein said co-oligomer is a statistical copolymer.

4. A co-oligomer or mixture as in claim 1 wherein the 1-alkene has from 10 to 14 carbon atoms in the molecule.

5. The method of making a synthetic oil which comprises mixing up to 95 percent by weight of a conventional synthetic oil with a co-oligomer consisting of A) 10–70 percent by weight of at least one 1-alkene have 8 to 14 carbon atoms in the molecule,
B) the balance being at least one (meth)acrylic acid ester of the formula
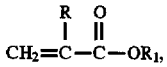
where R is hydrogen or methyl and $R_1$ is alkyl or cycloalkyl having 8 to 20 carbon atoms.
6. The method as in claim 5 wherein the 1-alkene has from 10 to 14 carbon atoms in the molecule.
* * * * *